US010240737B2

(12) United States Patent
Salter et al.

(10) Patent No.: US 10,240,737 B2
(45) Date of Patent: Mar. 26, 2019

(54) VEHICLE LIGHT ASSEMBLY

(71) Applicant: Ford Global Technologies, LLC, Dearborn, MI (US)

(72) Inventors: Stuart C. Salter, White Lake, MI (US); Aaron Bradley Johnson, Allen Park, MI (US); Paul Kenneth Dellock, Northville, MI (US); Stephen Kenneth Helwig, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 128 days.

(21) Appl. No.: 15/450,613

(22) Filed: Mar. 6, 2017

(65) Prior Publication Data

US 2018/0252384 A1 Sep. 6, 2018

(51) Int. Cl.

| | |
|---|---|
| ***F21S 41/25*** | (2018.01) |
| ***F21S 41/30*** | (2018.01) |
| ***F21S 41/40*** | (2018.01) |
| ***F21S 41/43*** | (2018.01) |
| ***F21S 41/125*** | (2018.01) |
| ***F21S 41/162*** | (2018.01) |

(52) U.S. Cl.

CPC ..... *F21S 41/125* (2018.01); *F21S 41/162* (2018.01); *F21S 41/25* (2018.01); *F21S 41/30* (2018.01); *F21S 41/40* (2018.01); *F21S 41/435* (2018.01)

(58) Field of Classification Search

CPC ..... F21S 41/125; F21S 41/30; F21S 41/25; F21S 41/40

See application file for complete search history.

(56) References Cited

U.S. PATENT DOCUMENTS

| | | | | |
|---|---|---|---|---|
| 1,599,300 | A | 9/1926 | Steingruber | |
| 2,486,859 | A | 11/1949 | Meijer et al. | |
| 5,053,930 | A | 10/1991 | Benavides | |
| 5,434,013 | A | 7/1995 | Fernandez | |
| 5,681,104 | A * | 10/1997 | Chinniah | F21S 41/43 362/538 |
| 5,709,453 | A | 1/1998 | Krent et al. | |
| 5,839,718 | A | 11/1998 | Hase et al. | |
| 6,012,830 | A * | 1/2000 | Fraizer | F21S 48/147 362/459 |
| 6,031,511 | A | 2/2000 | DeLuca et al. | |
| 6,099,156 | A * | 8/2000 | Jenkins | B29C 45/561 362/511 |
| 6,117,362 | A | 9/2000 | Yen et al. | |
| 6,294,990 | B1 | 9/2001 | Knoll et al. | |
| 6,419,854 | B1 | 7/2002 | Yocom et al. | |

(Continued)

FOREIGN PATENT DOCUMENTS

| | | | |
|---|---|---|---|
| CN | 101337492 | A | 1/2009 |
| CN | 201169230 | Y | 2/2009 |

(Continued)

*Primary Examiner* — Mary Ellen Bowman

(74) *Attorney, Agent, or Firm* — Vichit Chea; Price Heneveld LLP

(57) ABSTRACT

A light assembly for a vehicle is provided herein. The light assembly includes a housing and a lens. A light source is disposed between the housing and lens. A bulb shield is disposed between the light source and the lens. A peripheral portion of the bulb shield has a first optical transmittance and a central region of the bulb shield has a second optical transmittance.

20 Claims, 5 Drawing Sheets

(56) References Cited

U.S. PATENT DOCUMENTS 6,494,490 B1 12/2002 Trantoul
6,550,949 B1 * 4/2003 Bauer ..... B60Q 1/0023 362/545
6,577,073 B2 6/2003 Shimizu et al.
6,729,738 B2 5/2004 Fuwausa et al.
6,737,964 B2 5/2004 Samman et al.
6,773,129 B2 8/2004 Anderson, Jr. et al.
6,820,888 B1 11/2004 Griffin
6,851,840 B2 2/2005 Ramamurthy et al.
6,859,148 B2 2/2005 Miller
6,871,986 B2 3/2005 Yamanaka et al.
6,953,536 B2 10/2005 Yen et al.
6,990,922 B2 1/2006 Ichikawa et al.
7,015,893 B2 3/2006 Li et al.
7,161,472 B2 1/2007 Strumolo et al.
7,213,923 B2 5/2007 Liu et al.
7,216,997 B2 5/2007 Anderson, Jr.
7,249,869 B2 7/2007 Takahashi et al.
7,264,366 B2 9/2007 Hulse
7,264,367 B2 9/2007 Hulse
7,347,576 B2 3/2008 Wang et al.
7,441,914 B2 10/2008 Palmer et al.
7,501,749 B2 3/2009 Takeda et al.
7,575,349 B2 8/2009 Bucher et al.
7,635,212 B2 12/2009 Seidler
7,726,856 B2 6/2010 Tsutsumi
7,745,818 B2 6/2010 Sofue et al.
7,753,541 B2 7/2010 Chen et al.
7,834,548 B2 11/2010 Jousse et al.
7,862,220 B2 1/2011 Cannon et al.
7,987,030 B2 7/2011 Flores et al.
8,016,465 B2 9/2011 Egerer et al.
8,022,818 B2 9/2011 la Tendresse et al.
8,044,415 B2 10/2011 Messere et al.
8,066,416 B2 11/2011 Bucher
8,071,988 B2 12/2011 Lee et al.
8,097,843 B2 1/2012 Agrawal et al.
8,118,441 B2 2/2012 Hessling
8,120,236 B2 2/2012 Auday et al.
8,136,425 B2 3/2012 Bostick
8,163,201 B2 4/2012 Agrawal et al.
8,169,131 B2 5/2012 Murazaki et al.
8,178,852 B2 5/2012 Kingsley et al.
8,197,105 B2 6/2012 Yang
8,203,260 B2 6/2012 Li et al.
8,207,511 B2 6/2012 Bortz et al.
8,232,533 B2 7/2012 Kingsley et al.
8,247,761 B1 8/2012 Agrawal et al.
8,261,686 B2 9/2012 Birman et al.
8,286,378 B2 10/2012 Martin et al.
8,317,329 B2 11/2012 Seder et al.
8,317,359 B2 11/2012 Harbers et al.
8,408,766 B2 4/2013 Wilson et al.
8,415,642 B2 4/2013 Kingsley et al.
8,421,811 B2 4/2013 Odland et al.
8,459,832 B2 6/2013 Kim
8,466,438 B2 6/2013 Lambert et al.
8,519,359 B2 8/2013 Kingsley et al.
8,519,362 B2 8/2013 Labrot et al.
8,539,702 B2 9/2013 Li et al.
8,552,848 B2 10/2013 Rao et al.
8,606,430 B2 12/2013 Seder et al.
8,624,716 B2 1/2014 Englander
8,631,598 B2 1/2014 Li et al.
8,653,553 B2 2/2014 Yamazaki et al.
8,664,624 B2 3/2014 Kingsley et al.
8,683,722 B1 4/2014 Cowan
8,724,054 B2 5/2014 Jones
8,754,426 B2 6/2014 Marx et al.
8,773,012 B2 7/2014 Ryu et al.
8,846,184 B2 9/2014 Agrawal et al.
8,851,694 B2 10/2014 Harada
8,876,352 B2 11/2014 Robbins et al.
8,905,610 B2 12/2014 Coleman et al.
8,952,341 B2 2/2015 Kingsley et al.
8,994,495 B2 3/2015 Dassanayake et al.
9,006,751 B2 4/2015 Kleo et al.
9,018,833 B2 4/2015 Lowenthal et al.
9,057,021 B2 6/2015 Kingsley et al.
9,059,378 B2 6/2015 Verger et al.
9,065,447 B2 6/2015 Buttolo et al.
9,067,530 B2 6/2015 Bayersdorfer et al.
9,187,034 B2 11/2015 Tarahomi et al.
9,299,887 B2 3/2016 Lowenthal et al.
9,315,148 B2 4/2016 Schwenke et al.
9,452,709 B2 9/2016 Aburto Crespo
9,568,659 B2 2/2017 Verger et al.
9,616,812 B2 4/2017 Sawayanagi
2002/0085387 A1 * 7/2002 Taniuchi ..... B60Q 1/085 362/538
2002/0159741 A1 10/2002 Graves et al.
2002/0163792 A1 11/2002 Formoso
2003/0167668 A1 9/2003 Kuks et al.
2003/0174505 A1 * 9/2003 Wainwright ..... B60Q 1/16 362/485
2003/0179548 A1 9/2003 Becker et al.
2004/0091750 A1 * 5/2004 Oliver ..... A61C 1/16 428/698
2004/0121893 A1 * 6/2004 Minamikawa ..... C03C 10/0045 501/4
2004/0213007 A1 * 10/2004 Portillo ..... G09F 19/18 362/487
2004/0213088 A1 10/2004 Fuwausa
2005/0084229 A1 4/2005 Babbitt et al.
2005/0189795 A1 9/2005 Roessler
2006/0087826 A1 4/2006 Anderson, Jr.
2006/0097121 A1 5/2006 Fugate
2006/0114685 A1 * 6/2006 Seeber ..... B60Q 1/323 362/495
2007/0032319 A1 2/2007 Tufte
2007/0091629 A1 * 4/2007 Fukawa ..... B60Q 1/1415 362/509
2007/0172661 A1 * 7/2007 Fechner ..... A01N 59/16 428/409
2007/0285938 A1 12/2007 Palmer et al.
2007/0297045 A1 12/2007 Sakai et al.
2008/0205075 A1 8/2008 Hikmet et al.
2009/0217970 A1 9/2009 Zimmerman et al.
2009/0219730 A1 9/2009 Syfert et al.
2009/0251920 A1 10/2009 Kino et al.
2009/0260562 A1 10/2009 Folstad et al.
2009/0262515 A1 10/2009 Lee et al.
2010/0102736 A1 4/2010 Hessling
2011/0012062 A1 1/2011 Agrawal et al.
2011/0265360 A1 11/2011 Podd et al.
2011/0293923 A1 * 12/2011 Schmidt ..... C23C 18/1208 428/329
2012/0001406 A1 1/2012 Paxton et al.
2012/0104954 A1 5/2012 Huang
2012/0183677 A1 7/2012 Agrawal et al.
2012/0280528 A1 11/2012 Dellock et al.
2013/0050979 A1 2/2013 Van De Ven et al.
2013/0092965 A1 4/2013 Kijima et al.
2013/0335994 A1 12/2013 Mulder et al.
2014/0003044 A1 1/2014 Harbers et al.
2014/0029281 A1 1/2014 Suckling et al.
2014/0065442 A1 3/2014 Kingsley et al.
2014/0103258 A1 4/2014 Agrawal et al.
2014/0211498 A1 7/2014 Cannon et al.
2014/0264396 A1 9/2014 Lowenthal et al.
2014/0266666 A1 9/2014 Habibi
2014/0321140 A1 * 10/2014 Brendle ..... F21S 41/147 362/511
2014/0373898 A1 12/2014 Rogers et al.
2015/0046027 A1 2/2015 Sura et al.
2015/0085488 A1 3/2015 Grote, III et al.
2015/0109602 A1 4/2015 Martin et al.
2015/0138789 A1 5/2015 Singer et al.
2015/0267881 A1 9/2015 Salter et al.
2015/0307033 A1 10/2015 Preisler et al.
2015/0375672 A1 * 12/2015 Takahashi ..... G02B 6/0068 701/49
2016/0016506 A1 1/2016 Collins et al.

(56) References Cited

U.S. PATENT DOCUMENTS

| | | | |
|---|---|---|---|
| 2016/0102819 | A1 | 4/2016 | Misawa et al. |
| 2016/0131327 | A1 | 5/2016 | Moon et al. |
| 2016/0236613 | A1 | 8/2016 | Trier |
| 2016/0240794 | A1 | 8/2016 | Yamada et al. |
| 2017/0092890 | A1* | 3/2017 | Seo ..... H01L 51/5016 |
| 2017/0158125 | A1 | 6/2017 | Schuett et al. |
| 2017/0253179 | A1 | 9/2017 | Kumada |
| 2018/0003356 | A1* | 1/2018 | Muster ..... H01S 5/005 |

FOREIGN PATENT DOCUMENTS

| | | | |
|---|---|---|---|
| CN | 201193011 | Y | 2/2009 |
| CN | 204127823 | U | 1/2015 |
| DE | 4120677 | A1 | 1/1992 |
| DE | 29708699 | U1 | 7/1997 |
| DE | 202004001269 | U1 | 5/2004 |
| DE | 10319396 | A1 | 11/2004 |
| DE | 102004058153 | A1 | 10/2005 |
| DE | 202013002706 | U1 | 5/2013 |
| EP | 1793261 | A1 | 6/2007 |
| EP | 2778209 | A1 | 9/2014 |
| JP | 2000159011 | A | 6/2000 |
| JP | 2007238063 | A | 9/2007 |
| KR | 200160222 | Y1 | 8/1999 |
| KR | 20050024019 | A | 3/2005 |
| KR | 20060026531 | A | 3/2006 |
| WO | 2006047306 | A1 | 5/2006 |
| WO | 2014068440 | A1 | 5/2014 |
| WO | 2014161927 | A1 | 10/2014 |

* cited by examiner

VEHICLE LIGHT ASSEMBLY

FIELD OF THE INVENTION

The present invention generally relates to vehicular lighting, and more particularly to vehicle light assemblies disposed on an exterior portion of the vehicle.

BACKGROUND OF THE INVENTION

Illumination arising from the use of luminescent structures offers a unique and attractive viewing experience. It is therefore desired to implement such structures in automotive vehicles for various lighting applications.

SUMMARY OF THE INVENTION

According to one aspect of the present disclosure, a light assembly for a vehicle is disclosed. The light assembly includes a housing and a lens. A light source is disposed between the housing and lens. A bulb shield is disposed between the light source and the lens. A peripheral portion of the bulb shield has a first optical transmittance and a central region of the bulb shield has a second optical transmittance.

According to another aspect of the present disclosure, a light assembly is disclosed. The light assembly includes a housing and a lens. A light source is disposed between the housing and lens. A bulb shield is disposed between the light source and the lens. The bulb shield is light transmissive. A luminescent structure is disposed on the bulb shield configured to luminesce in response to receiving light from the light source.

According to yet another aspect of the present disclosure, a light assembly for a vehicle is disclosed. The light assembly includes a housing and a lens. A light source is disposed between the housing and lens. A bulb shield is disposed between the light source and the lens. The bulb shield is light transmissive. A light transmissive support structure is integrally formed with the bulb shield.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 2:
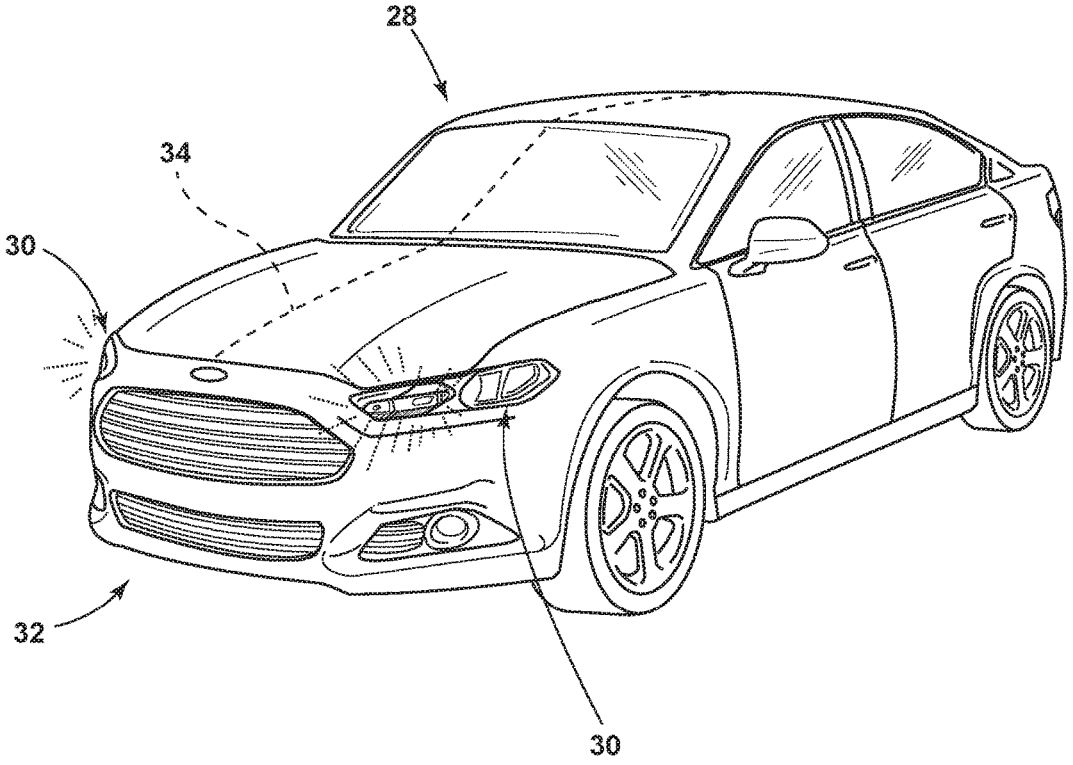
FIG. 2 is a front perspective view of a vehicle having a light assembly disposed on a front portion of the vehicle, according to various embodiments.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As required, detailed embodiments of the present invention are disclosed herein. However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

The following disclosure describes a light assembly for a vehicle. In various embodiments, the light assembly utilizes light generated by a headlamp assembly to excite one or more phosphorescent and/or luminescent structures. The one or more luminescent structures may be configured to convert excitation light received from the associated light source and re-emit the light at a different wavelength typically found in the visible spectrum.

Figure 1A:
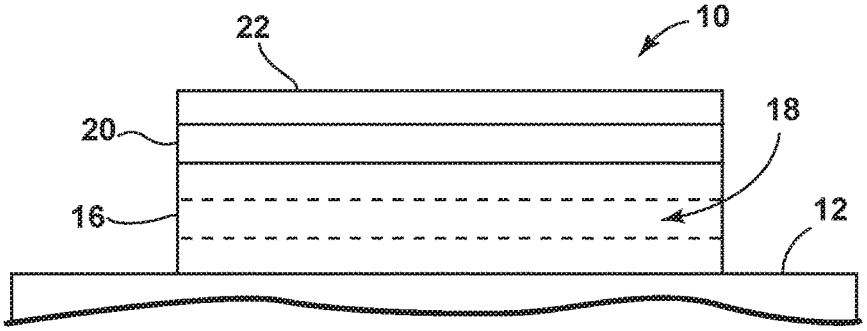
FIG. 1A is a side view of a luminescent structure rendered as a coating, according to various embodiments.
Figure 1B:
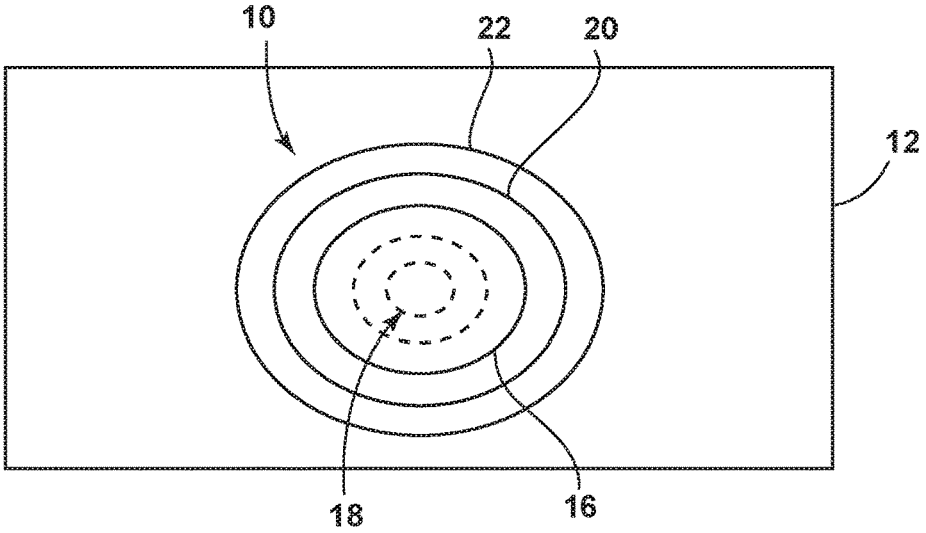
FIG. 1B is a top view of a luminescent structure rendered as a discrete particle according to various embodiments.
Figure 1C:
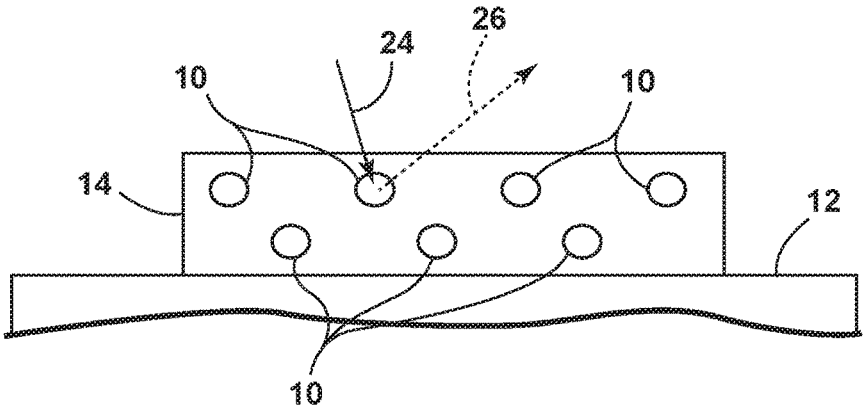
FIG. 1C is a side view of a plurality of luminescent structures rendered as discrete particles and incorporated into a separate structure.

Referring to FIGS. 1A-1C, various exemplary embodiments of luminescent structures 10 are shown, each capable of being coupled to a substrate 12, which may correspond to a vehicle fixture or vehicle-related piece of equipment. In FIG. 1A, the luminescent structure 10 is generally shown rendered as a coating (e.g., a film) that may be applied to a surface of the substrate 12. In FIG. 1B, the luminescent structure 10 is generally shown as a discrete particle capable of being integrated with a substrate 12. In FIG. 1C, the luminescent structure 10 is generally shown as a plurality of discrete particles that may be incorporated into a support medium 14 (e.g., a film) that may then be applied (as shown) or integrated with the substrate 12.

At the most basic level, a given luminescent structure 10 includes an energy conversion layer 16 that may include one or more sublayers, which are exemplarily shown through broken lines in FIGS. 1A and 1B. Each sublayer of the energy conversion layer 16 may include one or more luminescent materials 18 having energy converting elements with phosphorescent or fluorescent properties. Each luminescent material 18 may become excited upon receiving an excitation light 24 of a specific wavelength, thereby causing the light to undergo a conversion process. Under the principle of down conversion, the excitation light 24 is converted into a longer wavelength, converted light 26 that is outputted from the luminescent structure 10. Conversely, under the principle of up conversion, the excitation light 24 is converted into a shorter wavelength light that is outputted from the luminescent structure 10. When multiple distinct wavelengths of light are outputted from the luminescent structure 10 at the same time, the wavelengths of light may mix together and be expressed as a multicolor light.

Light emitted by a light source 40 (FIG. 3) may be referred to herein as excitation light 24 and is illustrated herein as solid arrows. In contrast, light emitted from the luminescent structure 10 may be referred to herein as converted light 26 and may be illustrated herein as broken arrows to represent the luminescence.

The energy conversion layer 16 may be prepared by dispersing the luminescent material 18 in a polymer matrix to form a homogenous mixture using a variety of methods. Such methods may include preparing the energy conversion layer 16 from a formulation in a liquid carrier support medium 14 and coating the energy conversion layer 16 to a desired substrate 12. The energy conversion layer 16 may be applied to a substrate 12 by painting, screen-printing, spraying, slot coating, dip coating, roller coating, and bar coating. Alternatively, the energy conversion layer 16 may be prepared by methods that do not use a liquid carrier support medium 14. For example, the energy conversion layer 16 may be rendered by dispersing the luminescent material 18 into a solid-state solution (homogenous mixture in a dry state) that may be incorporated in a polymer matrix, which may be formed by extrusion, injection molding, compression molding, calendaring, thermoforming, etc. The energy conversion layer 16 may then be integrated into a substrate 12 using any methods known to those skilled in the art. When the energy conversion layer 16 includes sublayers, each sublayer may be sequentially coated to form the energy conversion layer 16. Alternatively, the sublayers can be separately prepared and later laminated or embossed together to form the energy conversion layer 16. Alternatively still, the energy conversion layer 16 may be formed by coextruding the sublayers.

In various embodiments, the converted light 26 that has been down converted or up converted may be used to excite other luminescent material(s) 18 found in the energy conversion layer 16. The process of using the converted light 26 outputted from one luminescent material 18 to excite another, and so on, is generally known as an energy cascade and may serve as an alternative for achieving various color expressions. With respect to either conversion principle, the difference in wavelength between the excitation light 24 and the converted light 26 is known as the Stokes shift and serves as the principal driving mechanism for an energy conversion process corresponding to a change in wavelength of light. In the various embodiments discussed herein, each of the luminescent structures 10 may operate under either conversion principle.

Referring back to FIGS. 1A and 1B, the luminescent structure 10 may optionally include at least one stability layer 20 to protect the luminescent material 18 contained within the energy conversion layer 16 from photolytic and thermal degradation. The stability layer 20 may be configured as a separate layer optically coupled and adhered to the energy conversion layer 16. Alternatively, the stability layer 20 may be integrated with the energy conversion layer 16. The luminescent structure 10 may also optionally include a protective layer 22 optically coupled and adhered to the stability layer 20 or other layer (e.g., the conversion layer 16 in the absence of the stability layer 20) to protect the luminescent structure 10 from physical and chemical damage arising from environmental exposure. The stability layer 20 and/or the protective layer 22 may be combined with the energy conversion layer 16 through sequential coating or printing of each layer, sequential lamination or embossing, or any other suitable means.

Additional information regarding the construction of luminescent structures 10 is disclosed in U.S. Pat. No. 8,232,533 to Kingsley et al., the entire disclosure of which is incorporated herein by reference. For additional information regarding fabrication and utilization of luminescent materials to achieve various light emissions, refer to U.S. Pat. No. 8,207,511 to Bortz et al., U.S. Pat. No. 8,247,761 to Agrawal et al., U.S. Pat. No. 8,519,359 to Kingsley et al., U.S. Pat. No. 8,664,624 to Kingsley et al., U.S. Patent Publication No. 2012/0183677 to Agrawal et al., U.S. Pat. No. 9,057,021 to Kingsley et al., and U.S. Pat. No. 8,846,184 to Agrawal et al., all of which are incorporated herein by reference in its entirety.

According to various embodiments, the luminescent material 18 may include organic or inorganic fluorescent dyes including rylenes, xanthenes, porphyrins, and phthalocyanines. Additionally, or alternatively, the luminescent material 18 may include phosphors from the group of Ce-doped garnets such as YAG:Ce and may be a short-persistence luminescent material 18. For example, an emission by $Ce^{3+}$ is based on an electronic energy transition from $4D^1$ to $4f^1$ as a parity allowed transition. As a result of this, a difference in energy between the light absorption and the light emission by $Ce^{3+}$ is small, and the luminescent level of $Ce^{3+}$ has an ultra-short lifespan, or decay time, of $10^{-8}$ to $10^{-7}$ seconds (10 to 100 nanoseconds). The decay time may be defined as the time between the end of excitation from the excitation light 24 and the moment when the light intensity of the converted light 26 emitted from the luminescent structure 10 drops below a minimum visibility of 0.32 $mcd/m^2$. A visibility of 0.32 $mcd/m^2$ is roughly 100 times the sensitivity of the dark-adapted human eye, which corresponds to a base level of illumination commonly used by persons of ordinary skill in the art.

According to various embodiments, a $Ce^{3+}$ garnet may be utilized, which has a peak excitation spectrum that may reside in a shorter wavelength range than that of conventional YAG:Ce-type phosphors. Accordingly, $Ce^{3+}$ has short-persistence characteristics such that its decay time may be 100 milliseconds or less. Therefore, in various embodiments, the rare earth aluminum garnet type Ce phosphor may serve as the luminescent material 18 with ultra-short-persistence characteristics, which can emit the converted light 26 by absorbing purple to blue excitation light 24 emitted from the light source 40. According to various embodiments, a ZnS:Ag phosphor may be used to create a blue-converted light 26. A ZnS:Cu phosphor may be utilized to create a yellowish-green converted light 26. A $Y_2O_2S$:Eu phosphor may be used to create red converted light 26. Moreover, the aforementioned phosphorescent materials may be combined to form a wide range of colors, including white light. It will be understood that any short-persistence luminescent material known in the art may be utilized without departing from the teachings provided herein. Additional information regarding the production of short-persistence luminescent materials is disclosed in U.S. Pat. No. 8,163,201 to Kingsley et al., the entire disclosure of which is incorporated herein by reference.

Additionally, or alternatively, the luminescent material 18, according to various embodiments, disposed within the luminescent structure 10 may include a long-persistence luminescent material 18 that emits the converted light 26, once charged by the excitation light 24. The excitation light 24 may be emitted from any excitation source (e.g., any natural light source, such as the sun, and/or any artificial light source 40). The long-persistence luminescent material 18 may be defined as having a long decay time due to its ability to store the excitation light 24 and release the converted light 26 gradually, for a period of several minutes or hours, once the excitation light 24 is no longer present.

The long-persistence luminescent material 18, according to various embodiments, may be operable to emit light at or above an intensity of 0.32 mcd/$m^2$ after a period of 10 minutes. Additionally, the long-persistence luminescent material 18 may be operable to emit light above or at an intensity of 0.32 mcd/$m^2$ after a period of 30 minutes and, in various embodiments, for a period substantially longer than 60 minutes (e.g., the period may extend 24 hours or longer, and in some instances, the period may extend 48 hours). Accordingly, the long-persistence luminescent material 18 may continually illuminate in response to excitation from any light source 40 that emit the excitation light 24, including, but not limited to, natural light source (e.g., the sun) and/or any artificial light source 40. The periodic absorption of the excitation light 24 from any excitation source may provide for a substantially sustained charge of the long-persistence luminescent material 18 to provide for consistent passive illumination. In various embodiments, a light sensor 80 may monitor the illumination intensity of the luminescent structure 10 and actuate an excitation source when the illumination intensity falls below 0.32 mcd/$m^2$, or any other predefined intensity level.

The long-persistence luminescent material 18 may correspond to alkaline earth aluminates and silicates, for example, doped di-silicates, or any other compound that is capable of emitting light for a period of time once the excitation light 24 is no longer present. The long-persistence luminescent material 18 may be doped with one or more ions, which may correspond to rare earth elements, for example, Eu2+, Tb3+, and/or Dy3. According to one non-limiting exemplary embodiment, the luminescent structure 10 includes a phosphorescent material in the range of about 30% to about 55%, a liquid carrier medium in the range of about 25% to about 55%, a polymeric resin in the range of about 15% to about 35%, a stabilizing additive in the range of about 0.25% to about 20%, and performance-enhancing additives in the range of about 0% to about 5%, each based on the weight of the formulation.

The luminescent structure 10, according to various embodiments, may be a translucent white color, and in some instances reflective, when unilluminated. Once the luminescent structure 10 receives the excitation light 24 of a particular wavelength, the luminescent structure 10 may emit any color light (e.g., blue or red) therefrom at any desired brightness. According to various embodiments, a blue emitting phosphorescent material may have the structure $Li_2ZnGeO_4$ and may be prepared by a high-temperature solid-state reaction method or through any other practicable method and/or process. The afterglow may last for a duration of 2-8 hours and may originate from the excitation light 24 and d-d transitions of Mn2+ ions.

According to an alternate non-limiting exemplary embodiment, 100 parts of a commercial solvent-borne polyurethane, such as Mace resin 107-268, having 50% solids polyurethane in toluene/isopropanol, 125 parts of a blue-green long-persistence phosphor, such as Performance Indicator PI-BG20, and 12.5 parts of a dye solution containing 0.1% Lumogen Yellow F083 in dioxolane may be blended to yield a low rare earth mineral luminescent structure 10. It will be understood that the compositions provided herein are non-limiting examples. Thus, any phosphor known in the art may be utilized within the luminescent structure 10 without departing from the teachings provided herein. Moreover, it is contemplated that any long-persistence phosphor known in the art may also be utilized without departing from the teachings provided herein.

Additional information regarding the production of long-persistence luminescent materials is disclosed in U.S. Pat. No. 8,163,201 to Agrawal et al., the entire disclosure of which is incorporated herein by reference. For additional information regarding long-persistence phosphorescent structures, refer to U.S. Pat. No. 6,953,536 to Yen et al., U.S. Pat. No. 6,117,362 to Yen et al., and U.S. Pat. No. 8,952,341 to Kingsley et al., all of which are incorporated herein by reference in their entirety.

With further reference to FIGS. 1A-1C, according to various embodiments, the luminescent material 18 may include one or more quantum dots. Quantum dots are nanoscale semiconductor devices that tightly confine either electrons or electron holes in three spatial dimensions and may be luminescent. The luminescence of a quantum dot can be manipulated to specific wavelengths by controlling the particle diameter of the quantum dots. Quantum dots may have a radius, or a distance half of their longest length, in the range of between about 1 nm and about 10 nm, or between about 2 nm and about 6 nm. Larger quantum dots (e.g., radius of 5-6 nm) emit longer wavelength light resulting in the color of the light being such colors as orange or red. Smaller quantum dots (e.g., radius of 2-3 nm) emit shorter wavelengths resulting in colors such as blue and green. It will be understood that the wavelength of light emitted from the quantum dots may vary depending on the composition of the quantum dots. Quantum dots naturally produce monochromatic light. Exemplary compositions of the quantum dots include $LaF_3$ quantum dot nanocrystals that are doped (e.g., coated) with Yb—Er, Yb—Ho and/or Yb—Tm. Other types of quantum dots that can be used include various types of tetrapod quantum dots and perovskite-enhanced quantum dots. It will be understood that one or more types of quantum dots may be mixed or otherwise used in the luminescent material 18 to achieve a desired color or hue to the converted light 26.

The quantum dot embodiments of the luminescent material 18 may be configured to emit light in response to the excitation light 24. According to various embodiments, the quantum dots may be configured to emit light by up-converting excitation light 24. In up-conversion processes, two or more photons of a longer wavelength excitation light 24 are absorbed. Once absorbed, the quantum dots may emit one or more photons having a shorter wavelength than the wavelengths of the excitation light 24. According to various embodiments, the excitation light 24 may be in the infrared (IR) light spectrum. In such embodiments, the excitation light 24 may have a wavelength of between about 800 nm and about 1000 nm. In one exemplary embodiment, the excitation light 24 may have a wavelength of between 900 and 1000 nm, such as 980 nm. A wavelength between 900 and 1000 nm is chosen since red, blue and green emitting colloidal quantum dots of these species can efficiently absorb this wavelength of excitation light 24. This wavelength of light may be readily emitted from heated vehicle components (e.g., a light source 40 (FIG. 3) or a bulb shield 44 (FIG. 3) surrounding the light source 40). This means the luminescent structure 10 can emit virtually any color of converted light 26, including, but not limited to, converted light 26 within the white spectrum, when charged or excited with IR excitation light 24 and the proper sized quantum dots are used.

Referring to FIG. 2, a vehicle 28 is generally illustrated equipped with a pair of light assemblies 30 for providing vehicle exterior lighting. In the embodiment shown, the light assemblies 30 are configured as headlight or headlamp assemblies positioned near a front portion 32 of the vehicle 28 on opposing sides of a vehicle centerline 34. The light assemblies 30 provide exterior lighting for the vehicle 28, such as high and low beam headlight illumination that project light forward of the vehicle 28 and onto the roadway through the usage of one or more lamps. It should be appreciated that the light assemblies 30 may be located at other locations on the vehicle 28 and may be configured to provide other lighting functions such as a taillight, a turn light, a fog light, a daytime running light, or other lighting functions.

Figure 3:
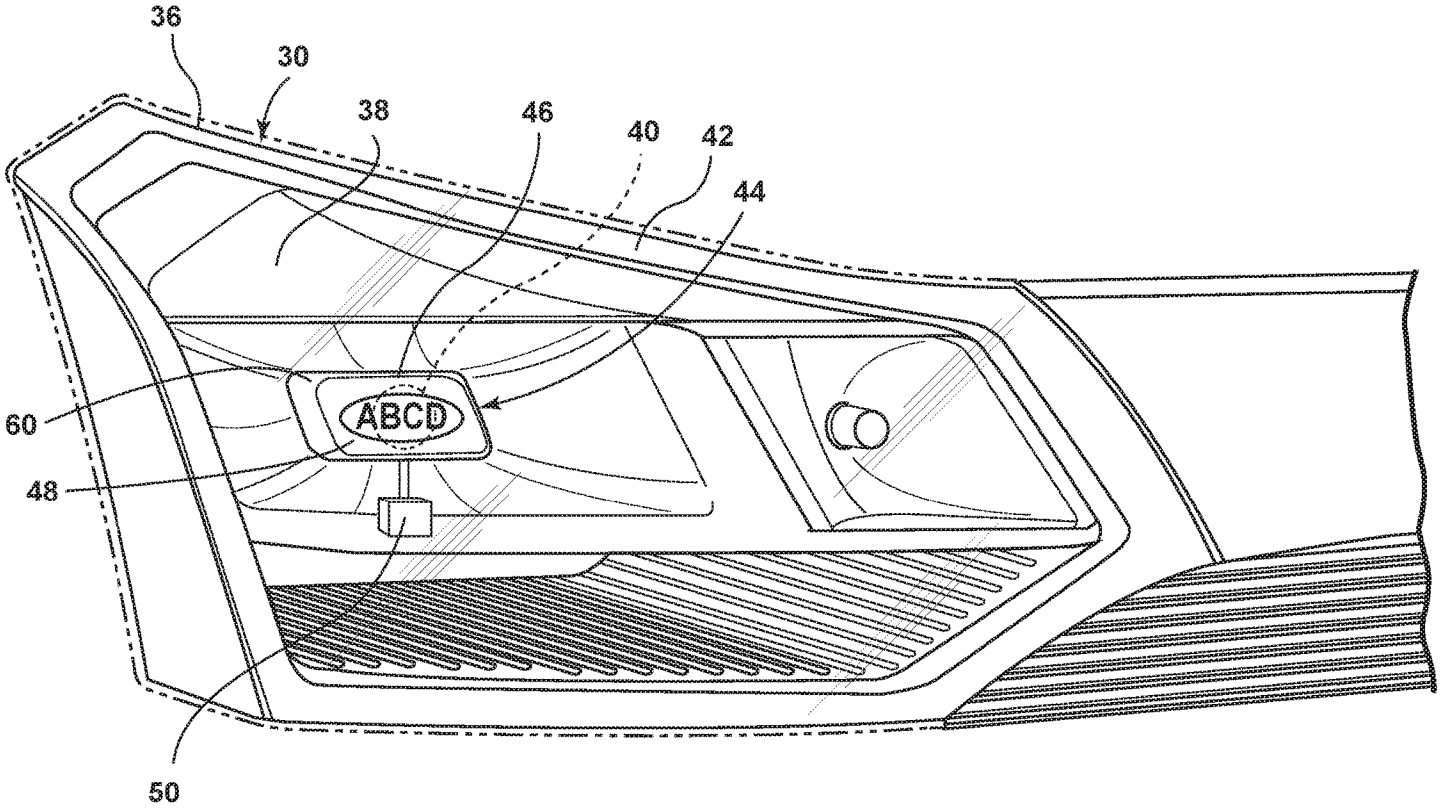
FIG. 3 is a front perspective view of the light assembly and a front portion of the vehicle, according to various embodiments.
Figure 4:
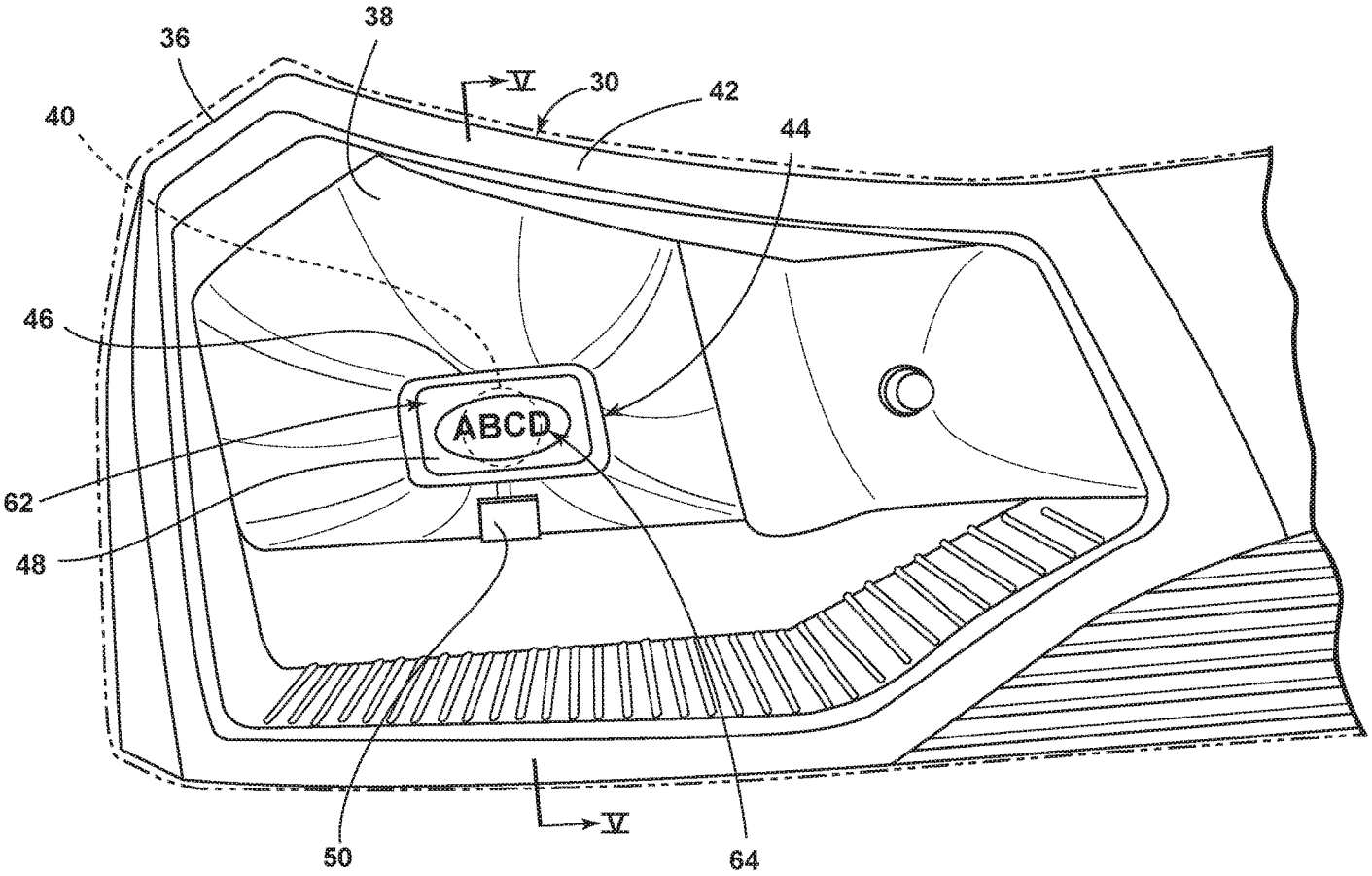
FIG. 4 is a front elevation view of the light assembly and the vehicle of FIG. 3.

Referring to FIGS. 3 and 4, the light assembly 30 has a housing 36 for securing the light assembly 30 to the vehicle 28. The light assembly 30 also includes a reflector 38 for reflecting light from the light assembly 30. The reflector 38 has a reflective surface for reflecting the light out of the light assembly 30. Additionally, the reflector 38 may have a generally parabolic shape for redirecting the light in a focused array. The parabolic surface of the reflector 38 may be formed from a continuous parabolic surface, or by multiple facets, as illustrated in the reflector 38 of FIGS. 3 and 4, that collectively provide a parabolic surface of the reflector 38.

The light assembly 30 also includes a light source 40, such as an incandescent bulb, halogen bulb, high-intensity discharge lamps (HID), and/or a light emitting diode (LED) for example, for illuminating outwardly from the vehicle 28. The light source 40 is mounted to the housing 36 and may be spaced apart from the reflector 38 for providing illumination that is reflected from the reflector 38 and out of the light assembly 30. The light source 40 generally radiates excitation light 24 omnidirectionally. Accordingly, the light source 40 is provided at a focal point of the parabolic reflector 38 such that omnidirectional light from the light source 40 is reflected from the reflector 38 and is focused into a forward path of illumination.

The light assembly 30 also includes a lens 42 for partially, or fully, enclosing the housing 36 and protecting the light source 40. The lens 42 is generally transparent and/or translucent and may be formed from a polymer, an elastomer, any other transparent or translucent material, and/or combinations thereof. The light assembly 30 is also provided with a bulb shield 44, which may prevent glare light from exiting the light assembly 30. The bulb shield 44 has a peripheral region 46 and a central region 48 that is disposed proximately to the light source 40 and is mounted to the housing 36 by a support structure 50. The light source 40 generally emits light rays omnidirectionally from the light source 40. The bulb shield 44 is configured to prevent some excitation light 24 emitted from the light source 40 from unimpeded exit through the lens 42. The bulb shield 44 may additionally assist in forming a desired light cone as the excitation light 24 exits the lens 42. It will be appreciated that the illumination patterns described herein may form light cones, which may be described as a surface in space-time, represented as a cone in three dimensions, including the points from which a light signal would reach a given point (at the apex) simultaneously, and that therefore appear simultaneous to an observer at the apex. Moreover, the light cone may be of any geometry without departing from the scope of the present disclosure.

While blocking the glare excitation light 24, the bulb shield 44 may absorb heat, which may be generated by one or more light source 40 within the light assembly 30, such as the light source 40. The radial symmetry of the peripheral region 46 of the bulb shield 44 results in a distribution of blocked glare light and therefore a distribution of heat to the bulb shield 44. To reduce heat absorption within the bulb shield 44, the bulb shield 44 may be formed from a heat-resistant elastomeric material such as PVC, latex, silicone, heat-resistant rubber (and its derivative materials), heat-resistant engineering polymers, polyalkylene-terephthalate, isophthalate, and/or copolyesters. For example, the bulb shield 44 may be formed from a material containing silicone due to its thermal stability over a wide temperature range.

Figure 5:
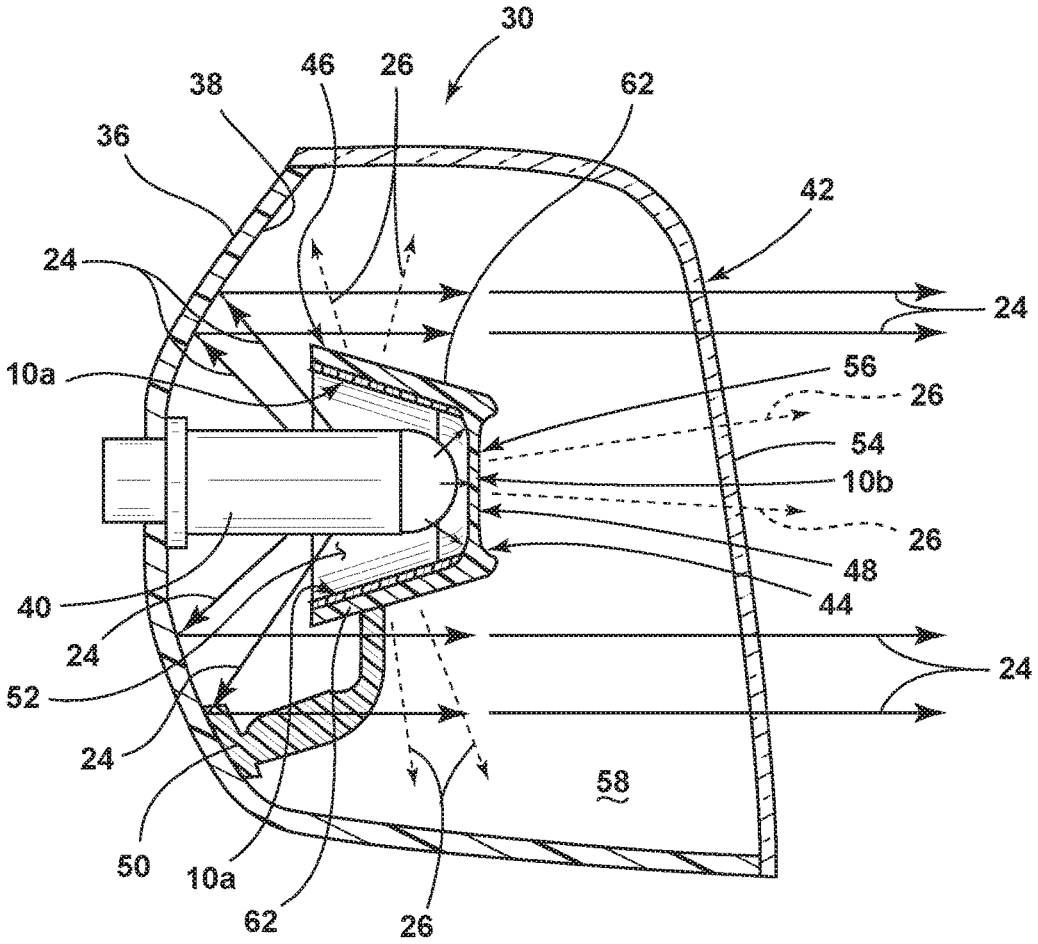
FIG. 5 is a cross-sectional view of the light assembly of FIG. 4 taken along the line V-V, according to various embodiments.

Referring to FIGS. 4 and 5, the bulb shield 44 defines a rear opening 52 for permitting omnidirectional excitation light 24, as illustrated in FIG. 5, to radiate from the light source 40 and reflect off the reflector 38 out of an exit region 54 of the lens 42. Further, the central region 48 of the bulb shield 44 may include optics 56 to direct the light generated by the light source 40 therethrough in a predefined pattern that then exits the light assembly 30 through the lens 42. For example, the central region 48 may be configured as a Fresnel lens, a pillow optic, and/or any other type of lens or optic that is configured to disperse, concentrate, and/or otherwise direct excitation light 24 emitted from the light source 40 therethrough in any desired manner.

In various embodiments, the bulb shield 44 of the light assembly 30 may have portions thereof that are further from the light source 40 than other portions. Therefore, while the bulb shield 44 blocks glare light, the bulb shield 44 may absorb heat unevenly. For example, the peripheral region 46 of the bulb shield 44 is illustrated as a polygon, such as a parallelogram that extends away from the light source 40, which may assist in dissipation of heat into the ambient air within a cavity 58 that is defined between the housing 36 and the lens 42. The peripheral region 46 may have rounded corners 60 (FIG. 3) that transition between the sides of the peripheral region 46.

According to various embodiments, the peripheral region 46 the bulb shield 44 may have a first optical transmittance and the central region 48 of the bulb shield 44 may have a second optical transmittance. According to various embodiments, the first optical transmittance may be lower than the second optical transmittance. Moreover, the first and/or second optical transmittance may be less than 20% transmittance, less than 10% transmittance, or less, meaning that the peripheral region 46 and/or the central region 48 may be nearly opaque, or fully opaque. The support structure 50 may also be formed from a transparent and/or translucent material having a third optical transmittance. Due to the transparent and/or translucent nature of the peripheral region 46, the central region 48, and/or the support structure 50, in various embodiments, the bulb shield 44 may be concealed and/or not readily visible to an onlooker of the vehicle 28.

The peripheral region 46 may have a lower optical transmittance due to a variance in the material utilized to form the peripheral region 46 and/or a decorative material 62 may disposed on and/or within the bulb shield 44. The decorative material 62 may include a material that is configured to control or modify an appearance of the bulb shield 44, and/or any other portion of the light assembly 30. For example, the decorative material 62 may be configured to confer a white appearance, or any other desired color or finish, to portions of light assembly 30, such as the lens 42. The decorative material 62 can be disposed on the bulb shield 44, and/or any other portion of the light assembly 30, through any method known in the art, including, but not limited to, sputter deposition, vacuum deposition (vacuum evaporation coating), electroplating, adhesives and/or printing onto a component of the light assembly 30. The decorative material 62 may be chosen from a wide range of materials and/or colors, including, but not limited to, silver, chrome, copper, bronze, gold, or any other metallic surface. Additionally, an imitator of any metallic material may also be utilized without departing from the teachings provided herein. In various embodiments, the decorative material 62 may be tinted any color to complement the vehicle 28.

In various embodiments, the decorative material 62, the peripheral region 46, the central region 48, and/or the support structure 50 may have a textured or grained surface. The grained surface may be produced by laser etching the bulb shield 44 and may provide for the light assembly 30 to have a varied or common appearance with proximately disposed components of the vehicle 28.

With further reference to FIGS. 4 and 5, a first luminescent structure 10*a* may be disposed on the peripheral region 46 of the bulb shield 44, which may further reduce the optical transmittance of the peripheral region 46. The first luminescent structure 10*a* may luminesce in response to receiving light from any light source 40 on the vehicle 28 and/or ambient light, such as the sun or approaching vehicles. A second luminescent structure 10*b* may be disposed on the central region 48 of the bulb shield 44. The first and/or second luminescent structures 10*a*, 10*b* may form indicia on the bulb shield 44, such as an emblem, logo, an artistic design (e.g., a cat's eye) or any other desired information.

While blocking some of the light produced by the light source 40, assisting in preventing glare to oncoming vehicles, the bulb shield 44 absorbs heat and/or IR light. The IR light may have a wavelength of between about 800 nm and about 1000 nm, which may be readily emitted from heated headlamp components (e.g., the light source 40 and/or the bulb shield 44). In operation, the light source 40 emits excitation light 24, which increases a cavity temperature within the cavity 58. When the bulb shield 44, or any other component of the light assembly 30, reaches a temperature sufficiently high to begin releasing thermal radiation as excitation light 24, the first and/or second luminescent structure 10*a*, 10*b* is excited and luminesces in response to receiving the excitation light 24. The converted light 26, or luminescence, may be visible to a human eye.

As illustrated in FIG. 5, a portion of excitation light 24 emitted from the light source 40 is transmitted through the central region 48 of the bulb shield 44. In operation, the second luminescent structure 10*b* receives the excitation light 24 and, in response, luminesces therefrom. The second luminescent structure 10*b* may contain long-persistence phosphorescent material 40 such that the second luminescent structure 10*b* continues to emit light for a period of time after the excitation light 24 is no longer present. For example, according to various embodiments, the second luminescent structure 10*b* may continue to emit light for four hours after the removal of the excitation light 24.

In various embodiments, the light source 40 may pulse light at predefined times, such as every five minutes, to re-excite the first and/or second luminescent structures 10*a*, 10*b* such that the first and/or second luminescent structures 10*a*, 10*b* continue to emit light above a predefined intensity. The light source 40 may pulse at any frequency without departing from the teachings provided herein.

Referring again to FIG. 5, the first and/or second luminescent structure 10*a*, 10*b* may be disposed between the light source 40 and the lens 42. In operation the first and/or second luminescent structures 10*a*, 10*b* may include a plurality of luminescent materials 18 therein that luminesce in response to receiving light of a specific wavelength. According to various embodiments, the first and/or second luminescent structures 10*a*, 10*b* discussed herein are substantially Lambertian; that is, the apparent brightness of the first and/or second luminescent structures 10*a*, 10*b* is substantially constant regardless of an observer's angle of view. As described herein, the color of the luminescence may be dependent on the particular luminescent materials 18 utilized in the first and/or second luminescent structures 10*a*, 10*b*. Additionally, a conversion capacity of the first and/or second luminescent structures 10*a*, 10*b* may be dependent on a concentration of the luminescent material 18 utilized in the first and/or second luminescent structures 10*a*, 10*b*. By adjusting the range of intensities that may excite the first and/or second luminescent structures 10*a*, 10*b*, the concentration, types, and proportions of the luminescent materials 18 in the first and/or second luminescent structures 10*a*, 10*b* discussed herein may be operable to generate a range of color hues.

According to various embodiments, the bulb shield 44 may be formed through a multi-shot molding process. Due to fabrication and assembly steps being performed inside a mold, molded multi-material objects may allow reduction in assembly operations and production cycle times. Furthermore, the product quality can be improved, and the possibility of manufacturing defects, and total manufacturing costs can be reduced. In multi-material injection molding, multiple different materials are injected into a multi-stage mold. The sections of the mold that are not to be filled during a molding stage are temporarily blocked. After the first injected material sets, then one or more blocked portions of the mold are opened and the next material is injected. This process continues until the required multi-material part is created.

According to various embodiments, a multi-shot molding process is used to create the bulb shield 44. Initially, the central region 48 of the bulb shield 44 may be formed through a first injection-molding step, or through successive steps, if necessary. The peripheral region 46 of the bulb shield 44 may then be formed in a successive step. Lastly, the support structure 50 may be formed with the peripheral region 46 or in a successive step. In alternative embodiments, additional components may be added during one of the injection steps, or successively added in additional injections to adhere more components to the bulb shield 44.

A variety of advantages may be derived from the use of the present disclosure. For example, use of the light assembly disclosed herein provides a unique aesthetic appearance to the vehicle thereby increasing the value of the vehicle to a customer. Moreover, the light assembly disclosed may allow for light emitted from a headlamp to be used in a more efficient manner. The light assembly provided herein may also assist in heat dissipation within the headlamp assembly. The light assembly may be manufactured at low costs when compared to standard vehicle headlamp assemblies.

According to various embodiments, a light assembly for a vehicle is provided herein. The light assembly includes a housing and a lens. A light source is disposed between the housing and lens. A bulb shield is disposed between the light source and the lens. A peripheral portion of the bulb shield has a first optical transmittance and a central region of the bulb shield has a second optical transmittance. The light assembly may be configured as a vehicle light assembly. Embodiments of the light assembly can include any one or a combination of the following features:

- the first optical transmittance may be lower than the second optical transmittance;
- a luminescent structure disposed on the bulb shield configured to luminesce in response to receiving light from the light source;
- a light transmissive support structure integrally formed with the bulb shield;
- the light source is operably coupled with a reflector and the bulb shield to prevent some light from the light source from unimpeded exit through the lens;
- the luminescent structure includes a plurality of quantum dots;
- the peripheral portion includes a first luminescent material and the central region includes a second luminescent material, the first and second luminescent materials configured to luminesce in varied wavelengths of converted light;
- the luminescent structure comprises at least one luminescent material configured to convert an excitation light into a visible light;
- the housing and lens are configured as a vehicle headlight assembly; and/or
- the lens is formed from a material containing silicone.

Moreover, the light assembly may be manufactured by coupling a housing and a lens; positioning a light source between the housing and the lens; disposing a bulb shield disposed between the light source and the lens; forming a peripheral portion of the bulb shield having a first optical transmittance; and forming a central region of the bulb shield having a second optical transmittance.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited, to physically mateable and/or physically interacting components and/or wirelessly interactable and/or wirelessly interacting components and/or logically interacting and/or logically interactable components.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A light assembly for a vehicle, comprising:

a housing and a lens;

a light source disposed between the housing and lens; and a bulb shield mounted to the housing by a support structure and disposed in a spaced relationship between the light source and the lens, wherein a peripheral portion of the bulb shield has a first optical transmittance and a central region of the bulb shield has a second optical transmittance.

2. The light assembly for a vehicle of claim 1, wherein the first optical transmittance may be lower than the second optical transmittance.

3. The light assembly for a vehicle of claim 1, further comprising:

a luminescent structure disposed on the bulb shield configured to luminesce in response to receiving light from the light source.

4. The light assembly for a vehicle of claim 3, wherein the support structure is light transmissive and integrally formed with the bulb shield, and wherein the support structure extends from a concave surface of the housing into a space defined by the housing and the lens.

5. The light assembly for a vehicle of claim 1, wherein the light source is operably coupled with a reflector and the bulb shield to prevent some light from the light source from unimpeded exit through the lens.

6. The light assembly for a vehicle of claim 3, wherein the luminescent structure includes a plurality of quantum dots.

7. The light assembly for a vehicle of claim 1, wherein the peripheral portion includes a first luminescent material and the central region includes a second luminescent material, the first and second luminescent materials configured to luminesce in varied wavelengths of converted light.

8. A light assembly, comprising:

a housing and a lens;

a light source disposed between the housing and lens;

a bulb shield disposed proximately to the light source and in a spaced relationship between the light source and the lens, wherein the bulb shield is light transmissive; and a luminescent structure disposed on the bulb shield configured to luminesce in response to receiving light from the light source.

9. The light assembly of claim 8, wherein a peripheral portion of the bulb shield has a first optical transmittance and a central region of the bulb shield has a second optical transmittance.

10. The light assembly of claim 9, further comprising:

a light transmissive support structure integrally formed with the bulb shield.

11. The light assembly of claim 9, wherein the first optical transmittance may be lower than the second optical transmittance.

12. The light assembly of claim 8, wherein the light source is operably coupled with a reflector and the bulb shield to prevent some light from the light source from unimpeded exit through the lens.

13. The light assembly of claim 9, wherein the luminescent structure includes a plurality of quantum dots.

14. The light assembly of claim 13, wherein the peripheral portion includes a first luminescent material and the central region includes a second luminescent material, the first and second luminescent materials configured to luminesce in varied wavelengths of converted light.

15. A light assembly for a vehicle, comprising:

a housing and a lens;

a light source disposed between the housing and lens;

a bulb shield disposed in a spaced relationship between the light source and the lens such that the bulb shield and the light source define a first gap and the bulb shield and the lens define a second gap, wherein the bulb shield is light transmissive; and a light transmissive support structure integrally formed with the bulb shield.

16. The light assembly for a vehicle of claim 15, wherein a peripheral portion of the bulb shield has a first optical transmittance and a central region of the bulb shield has a second optical transmittance.

17. The light assembly for a vehicle of claim 15, wherein the lens is formed from a material containing silicone.

18. The light assembly for a vehicle of claim 15, further comprising:

a luminescent structure disposed on the bulb shield configured to luminesce in response to receiving light from the light source.

19. The light assembly for a vehicle of claim 16, wherein the first optical transmittance may be lower than the second optical transmittance.

20. The light assembly for a vehicle of claim 18, wherein the luminescent structure comprises at least one luminescent material configured to convert an excitation light into a visible light.

* * * * *